US006286984B1

(12) United States Patent
Berg

(10) Patent No.: US 6,286,984 B1
(45) Date of Patent: Sep. 11, 2001

(54) LIGHT, ESPECIALLY TAILLIGHT, FOR MOTOR VEHICLES

(75) Inventor: Roland Berg, Bad Ditzenbach (DE)

(73) Assignee: Reitter & Schefenacker GmbH & Co. KG (DE)

( * ) Notice: Subject to any disclaimer, the term of this patent is extended or adjusted under 35 U.S.C. 154(b) by 0 days.

(21) Appl. No.: 09/288,057

(22) Filed: Apr. 7, 1999

(30) Foreign Application Priority Data

Apr. 9, 1998 (DE) ..... 198 15 963

(51) Int. Cl.[7] ..... F21V 29/00

(52) U.S. Cl. ..... 362/505; 362/227; 362/800; 362/231; 362/230; 362/542; 362/541; 362/540; 362/543; 362/544; 362/545

(58) Field of Search ..... 362/545, 540, 362/541, 542, 230, 231, 800, 227, 543, 544

(56) References Cited

U.S. PATENT DOCUMENTS

| | | | | |
|---|---|---|---|---|
| 4,977,487 | * | 12/1990 | Okamo | 362/32 |
| 5,567,036 | * | 10/1996 | Theobald et al. | 362/80 |
| 5,632,551 | * | 5/1997 | Roney et al. | 362/249 |
| 5,765,940 | * | 6/1998 | Levy et al. | 362/240 |
| 5,887,968 | * | 3/1999 | Logan | 362/240 |
| 6,027,235 | * | 2/2000 | Chen | 362/497 |

* cited by examiner

*Primary Examiner*—Stephen Husar
*Assistant Examiner*—Anabel M Ton
(74) *Attorney, Agent, or Firm*—R W Becker & Associates; R W Becker

(57) ABSTRACT

A light for motor vehicles has a housing having a peripheral edge. A light screen is connected to the peripheral edge of the housing. At least one light source is arranged at least at a portion of the peripheral edge behind the light screen within the housing.

18 Claims, 2 Drawing Sheets

LIGHT, ESPECIALLY TAILLIGHT, FOR MOTOR VEHICLES

BACKGROUND OF THE INVENTION

The invention relates to a light, especially, a taillight, for motor vehicles comprising at least one light means arranged behind a light screen at the peripheral edge of the housing.

Known taillights are equipped with a light means that is positioned on the housing wall behind the light screen. The light means is usually an incandescent light bulb illuminating the light screen. Frequently, the light screen is not fully illuminated by this light means.

It is an object of the present invention to design a taillight such that the light screen is illuminated across its entire surface perfectly and in a simple manner.

SUMMARY OF THE INVENTION

This object is solved with the inventive design such that a light source is arranged at the edge of the light. The light screen can thus be reliably illuminated across its entire surface. The light screen can also be illuminated in different colors and thereby perform different functions. If the light, respectively, its light screen is illuminated in red, the light can serve as a rear light or a brake light. The light source can be arranged at the edge of the taillight in a constructively simple manner and at low costs.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

Figure 1:
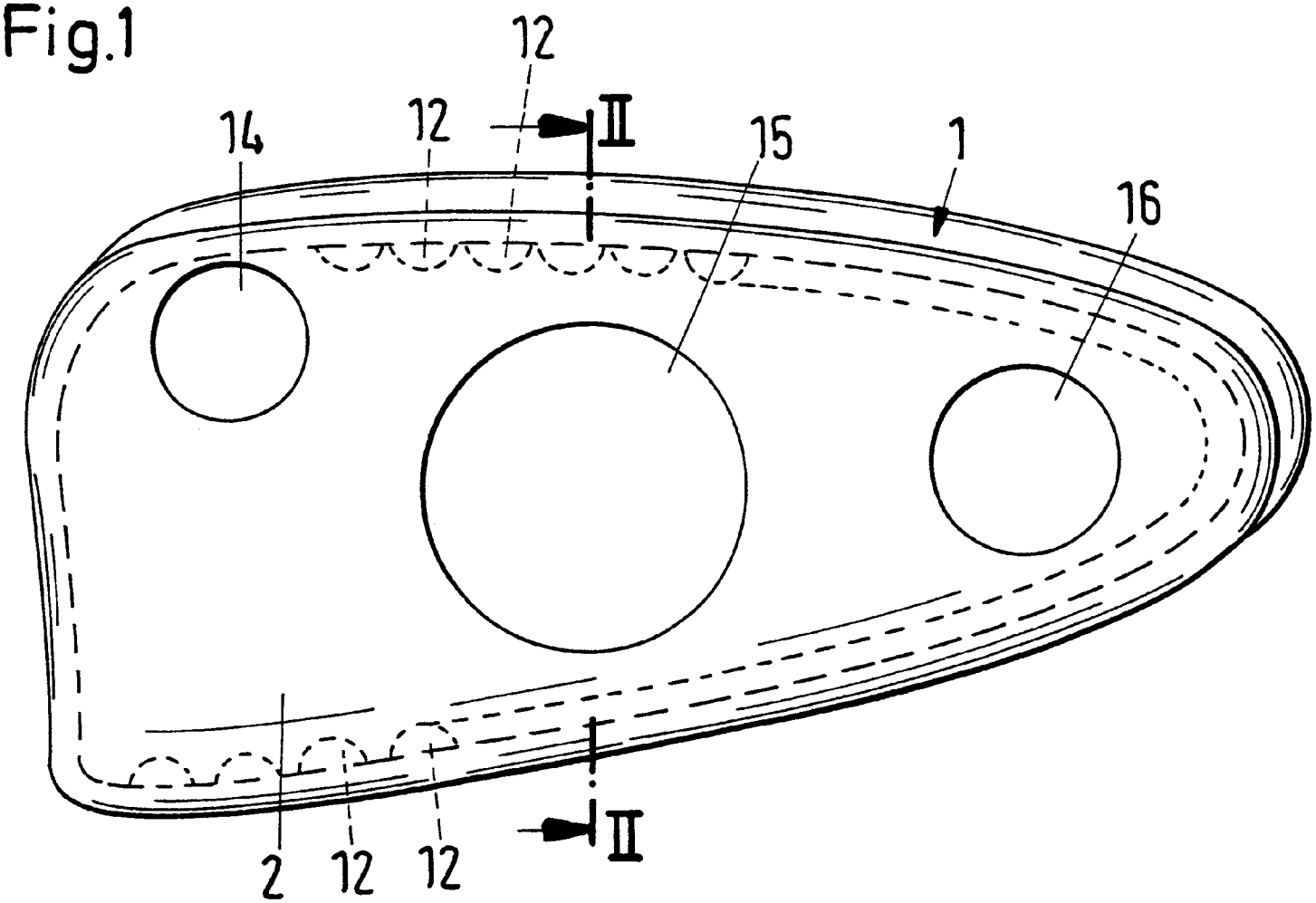
FIG. 1 shows a plan view of an inventive light in a schematic view.
Figure 2:
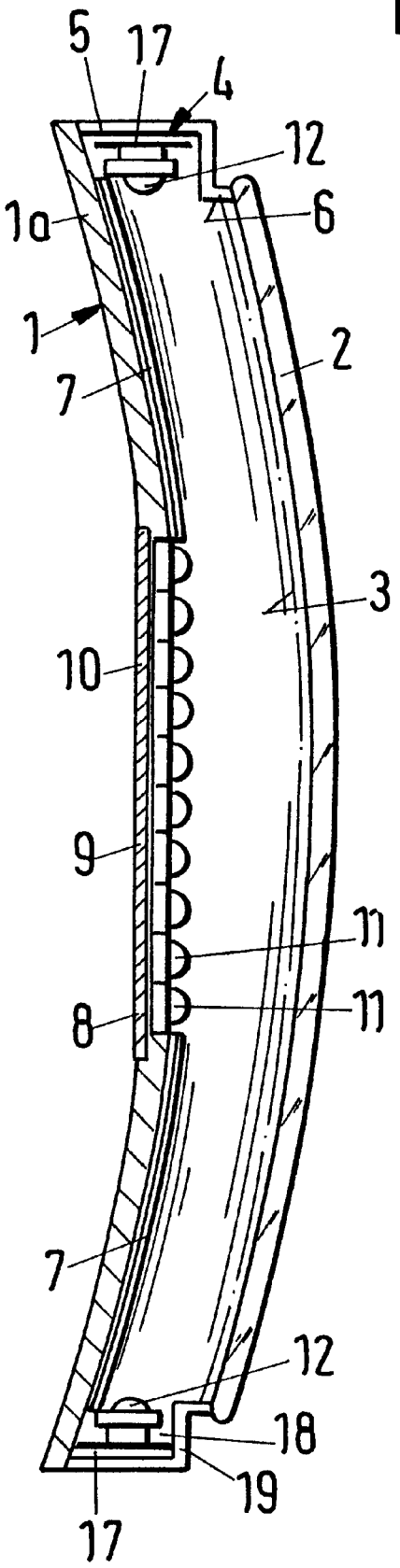
FIG. 2 shows an enlarged cross-sectional view along line II—II of FIG. 1.

The taillight illustrated in the drawings has a housing 1 with a housing wall 1*a*. A light screen 2 is arranged in front of the housing wall 1*a* at a distance to it and is connected to the housing wall 1*a* via a peripheral edge 4 that is part of the housing 1. The peripheral edge 4 and the housing wall 1*a* can be embodied as a monolithic part forming the housing 1. In the rear of the light screen 2, an optic 3 is provided, for example, a Fresnel optic. The peripheral edge 4 has a Z-shaped cross-section with a longer leg 5 which connects to the housing wall 1*a*. The rim of the light screen 2 rests against the shorter leg 6 of the peripheral edge 4. In the illustrated embodiment, the light screen 2 is curved in a circular arc shape. Of course, the housing wall 1*a* and the light screen 2 can have any other suitable shape. The interior surface of the housing wall 1*a* is embodied as a reflective surface 7. It is also possible to attach a reflecting member to the interior surface of the housing wall 1*a*. In the illustrated embodiment the housing wall 1*a* has three openings 8. Each opening 8 is provided with a printed circuit board 9 whose interior board surface carries a number of LEDs 11 arranged adjacent to one another. In the area of the openings 8, the light screen 2 is provided with one light window 14 to 16 for each opening 8. The light emitted by the respective LEDs 11 of the board 9 passes through the light windows 14 to 16 toward the outside. The light windows 14 to 16, and also preferably the corresponding openings 8 of the housing wall 1*a*, can have various sizes and/or shapes.

For example, the light window 14 can function as a turn signal and is colored yellow for that purpose. The light window 15 can be colored red and function as a brake light. Finally, the light window 16 can, for example, function as the rear light and can be colored red, accordingly. The light windows 14 to 16 can be provided at their inwardly facing sides with corresponding optics. It is also possible to use differently colored LEDs 11 for the different light windows 14 to 16 so that the light windows can consist of a transparent material. It is also possible to color the light windows 14 to 16 accordingly and to arrange correspondingly colored LEDs 11 at their inwardly facing sides. Instead of light means in the form of LEDs 11, it is also possible to employ fluorescent lights, neon lights, incandescent light bulbs or the like. Furthermore, it is possible to separate the individual light windows 14–16 from one another, at least, partially, e.g., by walls extending between the housing wall 1*a* and the light screen 2. This warrants that no stray light can impinge on the respective light windows 14 to 16. The light screen 2 can also be designed without the above described light windows. In that case, the respective areas of the light screen 2 light up when the respective LEDs 11 are activated.

At the peripheral edge 4, a further light source/sources are provided, preferably LEDs. Advantageously, a number of such LEDs is arranged in series about the peripheral edge 4. They can be provided either about a part of the peripheral edge 4 only, as illustrated in FIG. 1, or they can also be provided about the entire circumference of the peripheral edge 4. The LEDs (light sources) 12 are distributed such as to indirectly illuminate the entire light screen 2. Furthermore, a very flat structural design of the taillight is possible by using LEDs.

The LEDs 12 are arranged on a printed circuit board 17 which is supported at the peripheral edge 4 in a suitable way. Because of the Z-shaped cross-sectional embodiment of the edge 4, the printed circuit board 17 and the LEDs 12 are positioned in a receiving portion 18 which is laterally delimited by the housing wall 1*a* and the lateral stay 19 of the peripheral edge 4. The LEDs protrude partially from the receiving portion 18 into the interior of the taillight. The light beams emitted from the LEDs impinge preferably exclusively upon the reflective interior surface 7 from where they are reflected to the light screen 2. In this manner, the entire light screen 2 is indirectly illuminated. It is also possible, to arrange the LEDs 12 such that the light beams emitted by them partially impinge directly upon the light screen 2 and partially upon the reflective interior surface 7 at which they are reflected to the light screen 2. In this manner, the light screen 2 is also optimally illuminated across its entire surface. The reflective interior surface 7 needs to be provided only in that area of the housing wall 1*a* in which the light beams emitted by the LEDs 12 impinge upon the housing wall 1*a*. The light screen 2 can have a desired color, e.g., corresponding to the vehicle color. It is also possible to color the LEDs 12 accordingly. Instead of the LEDs 12, neon lights, fluorescent lights, incandescent light bulbs and the like can be used also.

In the illustrated embodiment, the taillight is a complete taillight assembly which comprises, e.g., the brake light, the turn signal, and the rear light. However, it is also possible to embody each individual light such that the light screen is illuminated by the LEDs 12 directly and indirectly in the described manner. In this case, the light screens are colored corresponding to the signal colors yellow (turn signal), red (brake and rear light) or clear (backing-up light), or the LEDs are provided with a corresponding color. The LEDs 11 and 12 as well as the corresponding printed circuit boards 9 and 17, respectively, are connected to the vehicle's electrical system.

The specification incorporates by reference the disclosure of German priority document 198 15 963.3 of Apr. 9, 1998.

The present invention is, of course, in no way restricted to the specific disclosure of the specification and drawings, but also encompasses any modifications within the scope of the appended claims.

What we claim is:

1. A light for motor vehicles, said light comprising:

a housing (1) having a peripheral edge (4) and a housing wall **(1*a*)**;

a light screen (2) connected to said peripheral edge (4) of said housing (1);

at least one light source (12) arranged at least at a portion of said peripheral edge (4) behind said light screen (2) within said housing (1), said peripheral edge (4) having a recessed receiving portion (18) and wherein said at least one light source (12) is at least partially received in said receiving portion (18), said peripheral edge (4) connecting said light screen (2) to said housing wall **(1*a*); and at least one additional light means (11) arranged in said housing (1) opposite to said light screen (2)**.

2. A light according to claim 1, wherein a plurality of said at least one light sources (12) are provided at said peripheral edge (4).

3. A light according to claim 1, wherein a plurality of said at least one light sources (12) are arranged adjacent to one another along said peripheral edge (4).

4. A light according to claim 1, wherein said at least one light source is an LED.

5. A light according to claim 1, wherein a portion of the light beams emitted by said at least one light source (12) impinges on said light screen (2).

6. A light according to claim 1, wherein said housing (1) has a reflective interior surface (7), and wherein a portion of the light beams emitted by said at least one light source (12) impinges on said reflective surface (7) and is reflected to said light screen (2).

7. A light according to claim 1, wherein said peripheral edge (4) has a recessed receiving portion (18) and wherein said at least one light source (12) is at least partially received in said receiving portion (18).

8. A light according to claim 7, wherein said peripheral edge (4) has a Z-shaped cross-section.

9. A light according to claim 7, wherein said housing (1) has a housing wall **(1*a*) and wherein said peripheral edge (4) connects said light screen (2) to said housing wall (1*a*)**.

10. A light according to claim 9, wherein said receiving portion (18) is delimited by a portion of said housing wall **(1*a*) and a portion of said peripheral edge (4)**.

11. A light according to claim 1, wherein said at least one additional light means (11) is arranged at said housing wall **(1*a*)**.

12. A light according to claim 1, wherein said at least one additional light means is an LED (11).

13. A light according to claim 1, wherein several of said at least one additional light means (11) are provided, wherein each one of said several additional light means (11) has a different signaling function.

14. A light according to claim 1, wherein said light screen (2) has at least one light window (14–16) opposite said at least one additional light means (11).

15. A light according to claim 1, wherein said at least one light window (14–16) is colored according to the signaling function of said at least one additional light means (11).

16. A light according to claim 1, wherein said at least one additional light means (11) is arranged on a printed circuit board (9), wherein said housing wall **(1*a*) has an opening (8), and wherein said printed circuit board (9) is positioned in said opening of said housing wall (1*a*)**.

17. A light according to claim 1, wherein said housing (1) has a reflective interior surface (7), wherein a portion of the light beams emitted by said at least one light source (12) impinges on said reflective interior surface (7) and is reflected to said light screen (2), and wherein said at least one additional light means (11) protrudes through said reflective interior surface (7) into the interior of said housing (1).

18. A light for motor vehicles, said light comprising:

a housing (1) having a reflective interior surface (7) and a peripheral edge (4);

a light screen (2) connected to said peripheral edge (4) of said housing (1);

at least one light source (12) arranged at least at a portion of said peripheral edge (4) behind said light screen (2) within said housing (1);

wherein a first portion of the light beams emitted by said at least one light source (12) impinges on said light screen (2) and wherein a second portion of the light beams emitted by said at least one light source (12) impinges on said reflective surface (7) and is reflected to said light screen (2).

* * * * *